US008746026B2

(12) United States Patent
Bruhin

(10) Patent No.: US 8,746,026 B2
(45) Date of Patent: Jun. 10, 2014

(54) METHOD FOR DETERMINING THE QUALITY OF A CRIMPED CONNECTION BETWEEN A CONDUCTOR AND A CONTACT

(75) Inventor: Leo Bruhin, Lucerne (CH)

(73) Assignee: Komax Holding AG, Dierikon (CH)

( * ) Notice: Subject to any disclaimer, the term of this patent is extended or adjusted under 35 U.S.C. 154(b) by 755 days.

(21) Appl. No.: 12/556,661

(22) Filed: Sep. 10, 2009

(65) Prior Publication Data

US 2010/0139351 A1 Jun. 10, 2010

(30) Foreign Application Priority Data

Oct. 2, 2008 (EP) ..... 08165675

(51) Int. Cl.
*B21C 51/00* (2006.01)

(52) U.S. Cl.
USPC ..... 72/20.1

(58) Field of Classification Search
USPC ..... 72/20.1–21.6; 29/407.08, 564–564.8, 29/33 M, 751, 863; 324/538
See application file for complete search history.

(56) References Cited

U.S. PATENT DOCUMENTS

| | | | | |
|---|---|---|---|---|
| 6,212,924 | B1 * | 4/2001 | Meisser | 72/21.4 |
| 6,418,769 | B1 * | 7/2002 | Schreiner | 72/21.4 |
| 6,819,116 | B2 * | 11/2004 | Ishibashi et al. | 324/538 |

FOREIGN PATENT DOCUMENTS

| | | | |
|---|---|---|---|
| DE | 4014221 | A1 | 11/1990 |
| EP | 0 460 441 | A1 | 12/1991 |
| EP | 0 902 509 | A1 | 3/1999 |
| EP | 1 071 174 | A2 | 1/2001 |

* cited by examiner

*Primary Examiner* — Shelley Self
*Assistant Examiner* — Matthew G Katcoff
(74) *Attorney, Agent, or Firm* — Fraser Clemens Martin & Miller LLC; William J. Clemens

(57) ABSTRACT

A method for determining the quality of a crimped connection between a conductor and a contact includes operating a crimping device to exert a crimping force on the conductor and the contact. From the crimping force curve that occurs during the crimping, a normalized force-distance crimping force curve is derived and a compression area is determined which lies under a reference crimping force curve. The crimping force curve and the reference crimping force curve are subdivided into several zones, the subdivision taking place under consideration of the size of the compression area. A further area that lies under the crimping force curve is determined and used to infer the quality of the crimped connection. A device for performing the method is provided.

10 Claims, 8 Drawing Sheets

METHOD FOR DETERMINING THE QUALITY OF A CRIMPED CONNECTION BETWEEN A CONDUCTOR AND A CONTACT

FIELD OF THE INVENTION

The invention relates to a method for determining the quality of a crimped connection between a conductor and a contact wherein a crimping device produces a crimping force by means of which the contact is electrically and mechanically unreleasably connectable with the conductor.

BACKGROUND OF THE INVENTION

The term "to crimp" is internationally established and defined in standards. In practice, however, terms such as "press", "squeeze", "stamp", or "apply" are also used. "Crimping" is to be understood as the creation of an unreleasable electrical and mechanical connection between a conductor and a contact. In the crimping operation, the material of the crimp contact and of the conductor that are to be connected is plastically, permanently deformed. When this occurs, poorly conducting surface layers, if present, are broken open, which favors the electrical conductivities. A correct crimping also prevents the penetration of corrosive media even under difficult operating conditions such as change of temperature or vibration.

The goal of crimping is to create a good mechanical and electrical connection which remains qualitatively unchanged in the long term.

For the purpose of crimping, use is made of contact-specific crimping tools with a stationary crimping anvil below and a vertically displaceable crimping stamp above (see FIG. 1 to FIG. 3). Mounted in the crimping tool are the crimping stamp for the conductor crimp and the crimping stamp for the insulation crimp, which usually by means of notched disks with different height cams can be set independently of each other in the vertical direction to the conductor diameter or the insulation diameter respectively. These settings directly affect the quality of the crimped connection.

In the case of open crimp contacts (see FIG. 4 and FIG. 5), feeding of the wire takes place above the contact. Usually, the previously insulation-stripped conductor is correctly positioned by machines for the crimping operation simultaneously in the radial and the axial direction. Through the downward movement of the crimping stamp, first the conductor is lowered by means of a mechanism into the upwardly opened conductor and insulation-crimp claws, after which the crimping operation per se begins, with deformation of the lugs corresponding to the forms of the crimping stamps. After the stroke of the crimping stamp, the crimp has the desired pressed form (see FIG. 5), which again depends on the contact sheet metal that is used, the conductor cross-section, the copper of the conductor, and the insulation stripping. With closed contacts, after being radially aligned the conductor must be inserted axially into the crimping area of the contact, which has the shape of a tube.

A cross-sectional view of a faultlessly executed crimped contact shows the originally individual round strands of the conductor pressed compactly against each other into polygons. In the crimp area of the contact, the inner surface shows deformations of the contact points of the individual strands.

An important parameter for the degree of pressing of the conductor crimp is the Crimp Compression Ratio (OCR), defined as the ratio of the cross-sectional area of the crimped conductor crimp (CCS), see FIG. 6*a*, to the sum of the cross-sectional areas of the conductor (WCS) and of the contact part (TCS) before deformation, see FIG. 6*b*, according to the formula:

$$CCR = \frac{CCS}{WCS + TCS} \cdot 100\%$$

A quality goal is to attain a certain Crimp Compression Ratio (CCR) irrespective of whichever conductor cross-section is processed. This is achieved by the corresponding crimp height being specified for each conductor cross-section.

The conductor crimp must enclose all of the individual strands. At the front end of the conductor crimp the individual strands, depending on their cross section, must project by about 0.5 mm and must not disappear into the crimp. In the window that is situated between the conductor crimp and the insulation crimp, the conductor and the conductor insulation must be visible. The insulating crimp must surround the insulation without penetrating into the latter.

Important criteria for the appraisal of a crimped connection are the crimp form, the crimp height as a measure of the Crimp Compression Ratio, and the conductor pull-out strength. However, these criteria are only suitable when setting up the crimping machine and for random sampling during production. To satisfy the present-day quality requirements for all crimped connections, means must be available which, during the crimping operation, can record, analyze, and save crimping data about each crimped connection and influence results-oriented machine data. For the appraisal of the crimped connection (without mechanical destruction of the crimped connection) the crimping force is placed in relation to the crimping distance or the crimping time. With corresponding analysis of the crimping data, the quality of a crimped connection can be reliably appraised.

A method or device for appraisal of the quality of a crimped connection must detect crimp faults such as incorrect insulation crimp height, incorrect conductor crimp height, omitted strands in the conductor crimp, incorrect or no stripped insulation length, incorrect insertion depth, or strands cut off during insulation-stripping, and generate corresponding error messages.

Prior Art

From European patent application EP 0 460 441 a method has become known for the detection of missing strands, or of crimped-in conductor insulation, in a crimped connection by reference to the pattern of the crimping force. During a crimping operation, value pairs consisting of crimping force and position of the crimping stamp are measured and saved. The value pairs that are measured during the creation of a crimped connection give the pattern of crimping force of the crimping operation with the crimping force depending on the position of the crimping stamp. The section of the curve with sharply increasing force is linearized and a point is determined from the mean of the minimum and the maximum crimping force. The point is compared with a reference value. If the point lies within a predefined deviation from the reference value, the crimped connection is of acceptable quality. When analyzing the pattern of the crimping force of the crimping operation, the maximum crimping force is also considered. If the maximum crimping force deviates excessively from a reference value, the crimped connection is rejected as unusable. The point in the section of the curve with sharply increasing force, and the maximum crimping force, provide information about missing strands or about crimped-in conductor insulation in the crimped connection.

In a normal commercially available crimping press, during the crimping operation a force sensor registers the force, which is saved in digital form as a force-dependent curve pattern. This is compared with a reference curve. Depending on the magnitude of the deviation from the reference, the type of crimping fault is determined.

Disadvantageous with this method is that, despite great outlay for computing, saving, and calculation, no meaningful statement about the quality of the crimped connection is possible.

Also known from prior art European EP 0 902 509 B1 is a crimping device having a crimping stamp with which a contact can be connected with a conductor. The crimping device includes a force sensor which is arranged above the crimping stamp to determine the crimping force.

To determine the quality of the crimped connection, the crimping force curve is plotted and subdivided into several zones. To determine the width of the first and of the second zone, the width of the fourth zone is multiplied by a factor between 0 and 2. The highest point on the reference crimping force curve is normalized to 100%. The width of the third zone is then determined through the two 90% points on the reference crimping force curve.

SUMMARY OF THE INVENTION

It is here that the invention sets out to provide a remedy. An objective of the invention is to propose a method and a device in which the aforesaid disadvantages are avoided and which results in an improved quality assurance.

The object is fulfilled by a method for determining the quality of a crimped connection between a conductor and a contact, in which, by means of a crimping device, a crimping force is exerted on the conductor and the contact, in which the crimping force curve that occurs during the crimping is determined, in which a compression surface that lies under a reference crimping force curve is determined, in which the crimping force curve and the reference crimping force curve are subdivided into several zones, the subdivision taking place under consideration of the size of the compression surface, and in which at least one further area that lies under the crimping force curve is determined, the area being a measure for the quality of the crimping connection.

In addition, the object is fulfilled by a device for execution of the method with a crimping stamp, with a linear sensor to register the position of the crimping stamp, with a force sensor to register the crimping force, and with an analyzer unit, which is connected with the linear sensor and the force sensor and embodied and operable in such manner that with it the quality of a crimped connection is determinable.

The crimping device for crimping a conductor and a contact, in accordance with the invention, includes a crimping stamp, with a linear sensor to register the position of the crimping stamp, with a force sensor to register the crimping force, and with an analyzer unit, which is connected with the linear sensor and the force sensor and embodied and operable in such manner that with it the quality of a crimped connection is determinable.

The advantages obtained from the invention are essentially to be seen in that, with the improved discrimination of the faults, an increase in quality is possible, that with the more sensitive fault diagnosis fewer rejects occur, and that consequential faults, for example a breakdown of a passenger car due to a loose connection in a plugged connection, are avoided.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Ways of Executing the Invention

Figure 1:
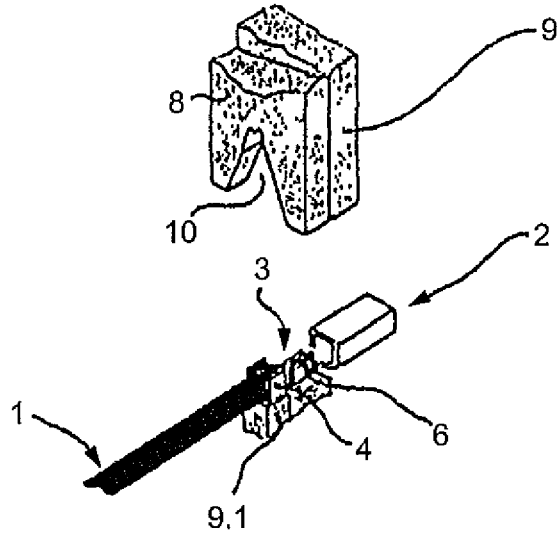
Fig. 1 (PRIOR ART)
FIG. 1 is a perspective view of a wire and a contact before crimping.
Figure 2:
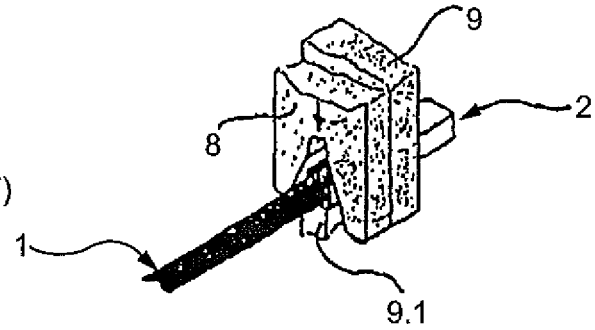
Fig. 2 (PRIOR ART)
FIG. 2 shows the wire and the contact during crimping.
Figure 3:
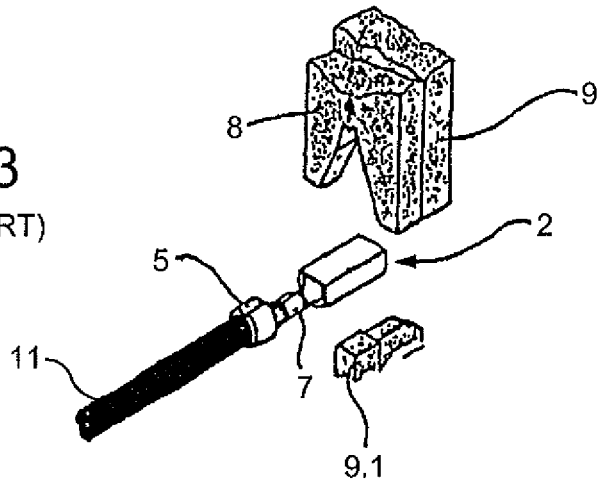
Fig. 3 (PRIOR ART)
FIG. 3 shows the wire and the contact after crimping.

FIGS. 1 to 3 show a crimping operation in which the end of a wire 1, out of which a portion of conductor projects, is connected with a contact 2. An open crimp zone 3 of the contact 2 has a first double lug 4 for the insulation crimp 5 and a second double lug 6 for a conductor crimp 7. FIG. 1 shows crimping stamps 8, 9 in the upper dead-point position. The end of the conductor insulation lies in the first double lug 4, and the stripped-wire section lies in the second double lug 6. As shown in FIG. 2, when the crimping stamps 8, 9 are lowered, the double lugs 4, 6 are pressed against each other by means of wedge-shaped notches 10, which are located in the crimping stamps 8, 9. An anvil 9.1 serves as support. A concave upper end of the notch 10 gives the double lug 4, 6, together with the conductor insulation 11 or the conductor respectively, its final form. FIG. 3 shows the finished crimped connection with the insulating crimp 5, in which the first double lug 4 is pressed around the conductor insulation 11, and with the conductor crimp 7, in which the second double lug 6 is pressed around the conductor.

Figure 4:
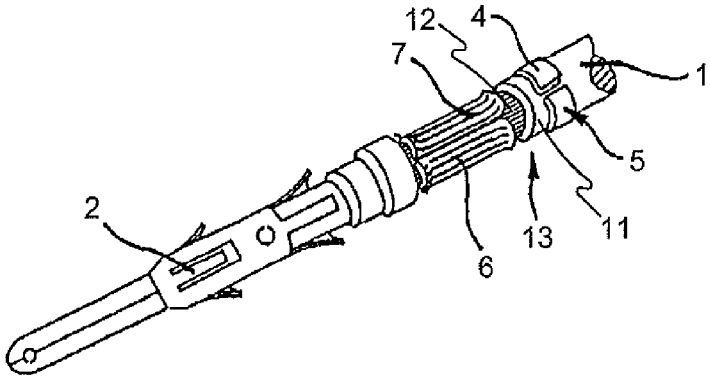
Fig. 4 (PRIOR ART)
FIG. 4 shows a crimped connection between the conductor and a contact.

FIG. 4 shows a faultless crimped connection in which, in a window 13, the insulation 11 of the wire 1 and the individual strands of the conductor 12 are visible. At the contact end of the conductor crimp 7, the individual strands are again visible.

Figure 5:
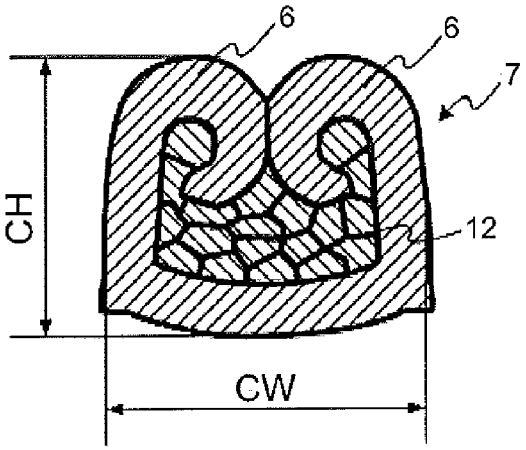
Fig. 5 (PRIOR ART)
FIG. 5 shows the crimped connection of FIG. 4, in cross section.

FIG. 5 shows a good crimped connection 7 in cross section. Depending on the stroke of the crimping stamps 8, 9, the crimp 7 has the desired pressed form with a crimp height CH and a crimp width CW.

Figure 6A:
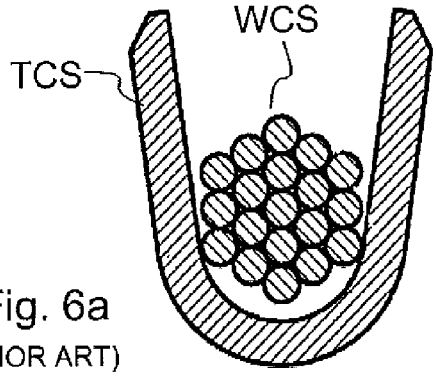
Fig. 6a (PRIOR ART)
FIG. 6*a* shows a contact and a conductor before crimping, in cross section.

FIG. 6*a* shows a contact and a conductor, before crimping, in cross section.

Figure 6B:
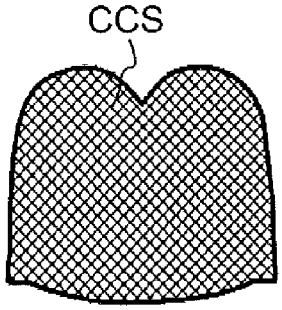
Fig. 6b (PRIOR ART)
FIG. 6*b* shows the contact and the conductor after crimping, in cross section.

FIG. 6*b* shows the contact and the conductor, after crimping, in cross section.

Figure 7:
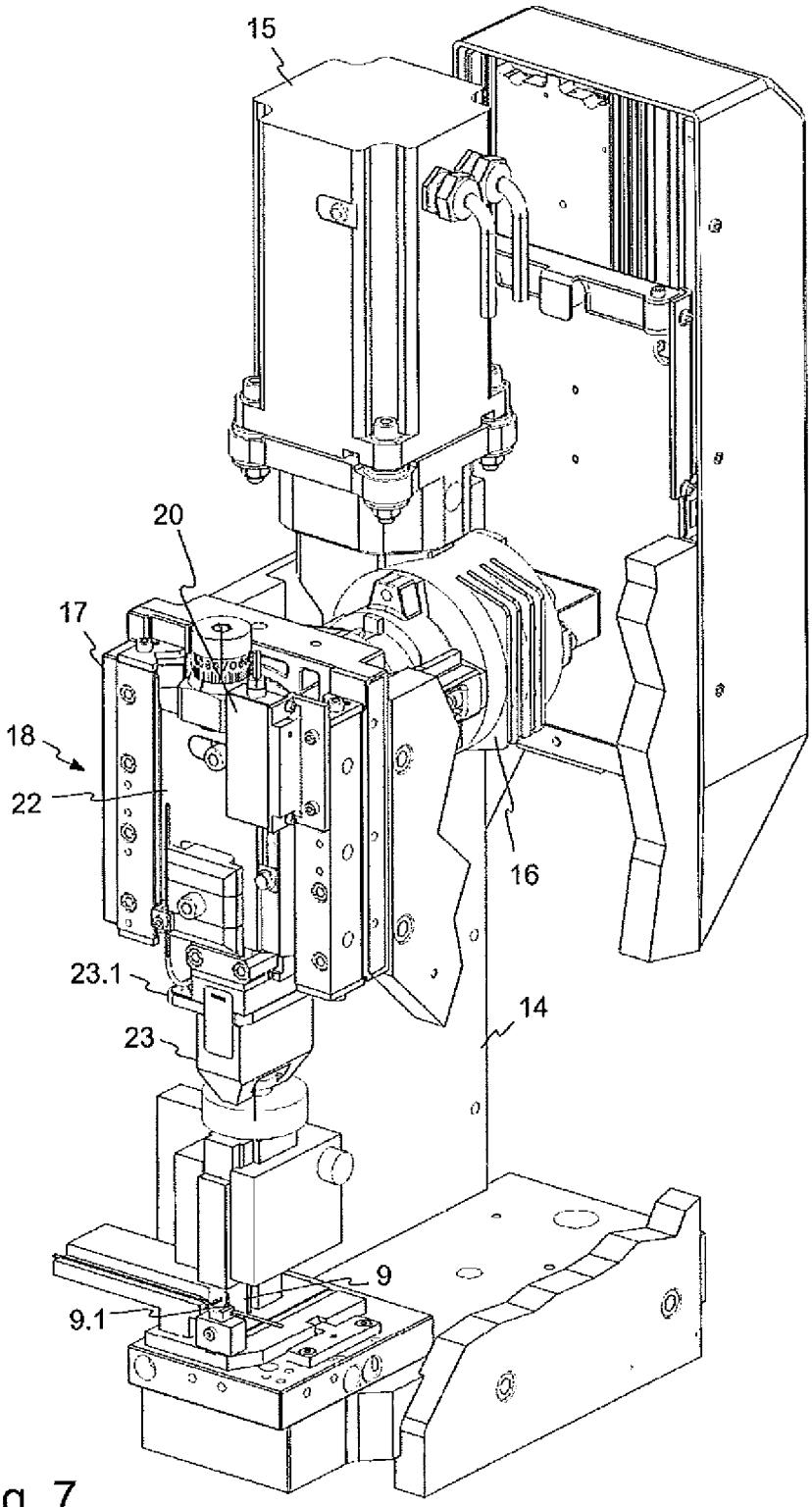
FIG. 7 shows a crimping press according to the invention in a perspective view.
Figure 8:
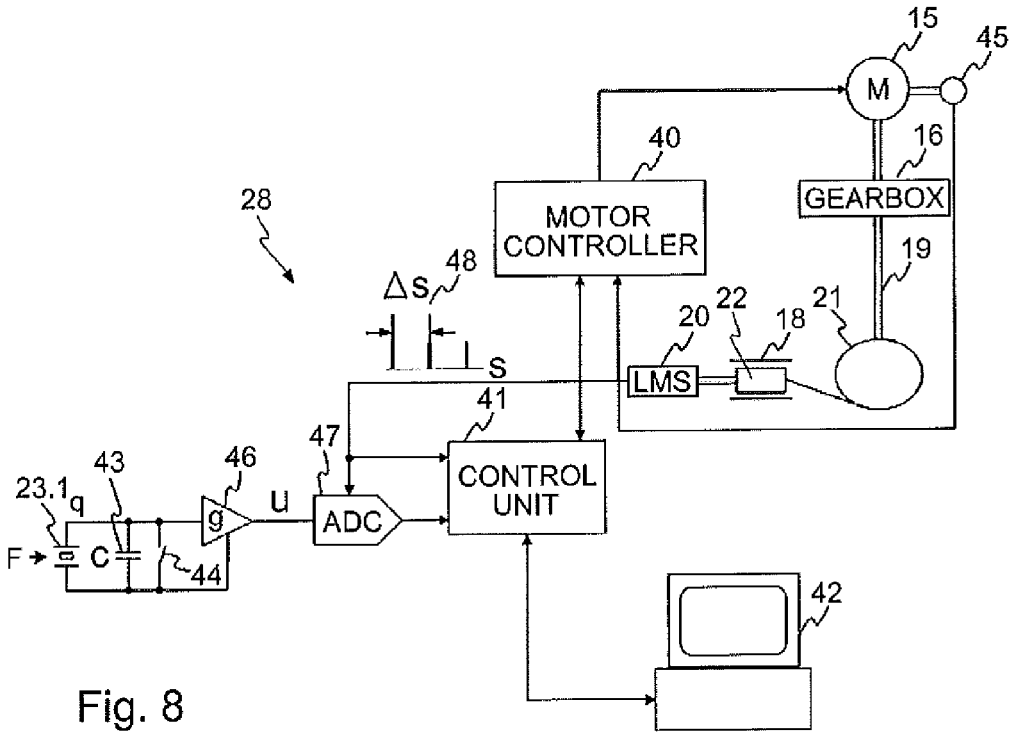
FIG. 8 shows a block diagram of a first embodiment of a control according to the invention together with a part of the crimping press.
Figure 9:
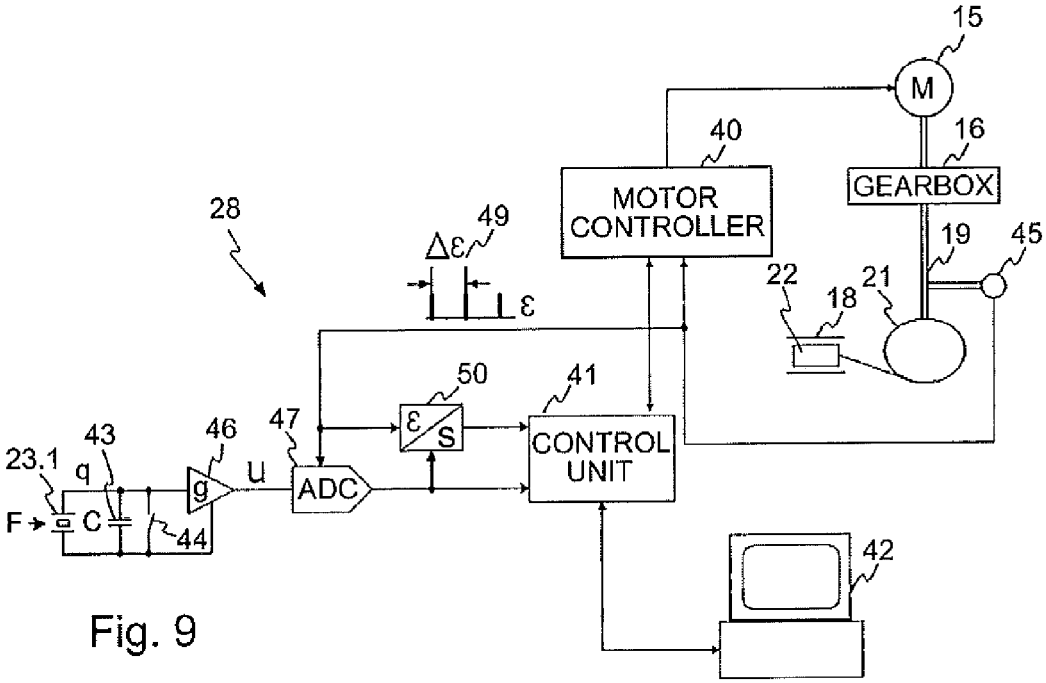
FIG. 9 shows a block diagram of a second embodiment of the control together with a part of the crimping press.

FIG. 7 shows a possible embodiment of a crimping press in a perspective view. The crimping press includes a stand 14, which in FIG. 7 is shown partly broken away. Arranged on the stand 14 is a motor 15 with a gearbox 16. Also arranged on the stand 14 are first guides 17 on which a ram 18 is guided. A shaft 19 that is driven by the gearbox 16 has at one end an eccentric pin. The ram 18 comprises a slide 22, which is guided in the first guides 17, and a tool holder 23 with force sensor 23.1. The slide 22 is loosely connected with the eccentric pin, whereby the rotational movement of the eccentric pin is transformed into a linear movement of the slide 22. The position of the slide 22, and hence of the ram 18, is registered with a linear sensor 20. The maximum stroke of the slide 22 is determined by the upper dead point and the lower dead point of the eccentric pin 21 (FIGS. 8 and 9). The tool holder 23 usually actuates the crimping tool 8, 9 (FIG. 1) which, together with an anvil 9.1 that forms part of the crimping tool, produces the crimped connection.

FIG. 8 shows in a first block circuit diagram a first embodiment of a control 28 together with parts of the crimping press that is shown in FIG. 7. The control 28 is embodied as a control loop and serves to control the crimping press. The control loop contains a motor controller 40, the motor 15, and an angle sensor 45 for registration of the angle of rotation of the motor shaft. The crimping movement for a stroke is regulated according to a predefined velocity-angle profile of the motor controller 40. The rotational movement is transferred from the motor 15 to the gearbox 16 and then to the shaft 19, on one end of which the eccentric pin 21 is arranged. The eccentric pin 21 sets the slide 22 of the ram 18 in linear motion.

The position of the slide 22 of the ram 18 is registered by the linear sensor 20. The linear sensor 20 comprises a scale with equidistantly (separation Δs) arranged position markings which are applied to the slide 22 of the ram 18. In addition, the linear sensor 20 contains a stationary reading head. The linear sensor 20 generates an electrical voltage impulse 48 whenever one of the position markings passes the reading head.

The force sensor 23.1 measures the force F that is used during the crimping operation for the deformation. The force sensor 23.1 is based on the piezoelectric effect and generates a charge q that is proportional to the force F. The proportionality factor is the charging constant "k". A capacitor 43 with capacity C is connected in parallel with the force sensor 23.1 and, together with a succeeding voltage amplifier 46, forms a charging amplifier. The output voltage u on the output of the charging amplifier is found from the formula $$u = \frac{k \cdot g}{C} \cdot F$$

where g is the amplification factor of the voltage amplifier 46.

In addition, a discharging switch 44 is provided which discharges the charge of the capacitor 43 before each crimping cycle. An analog-digital converter 47 which is connected after the charging amplifier digitalizes the output voltage u, which represents the utilized force F, synchronous with the position impulses 48 that are supplied by the linear sensor 20. From the digitalized force F and the position impulses 48, the force-distance curve of the crimping operation is formed. A control unit 42 handles the storage and analysis of the force-distance curve.

FIG. 9 shows an alternative embodiment of the control 28. This differs from the embodiment according to FIG. 8, firstly in that the angle sensor 45 registers the angle of rotation ϵ of the shaft 19 and for this purpose is in contact with the shaft. It differs from the embodiment according to FIG. 8 secondly in that the position of the slide 22 is not registered by the linear sensor 20 (FIG. 8) but by the angle sensor 45. With the aid of a corresponding converter 50, the angle ϵ that is supplied by the angle sensor 45 is transformed into a stroke s. From the digitalized force F, and the thus determined distance s, the force-distance curve of the crimping operation is then formed.

Figure 10A:
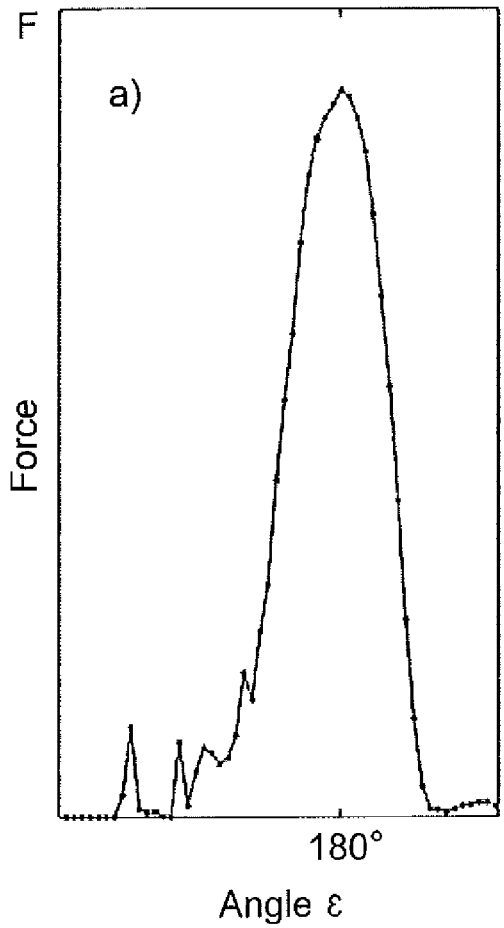
FIG. 10*a* shows a force-angle curve which was recorded with the control according to FIG. 9.

FIG. 10*a* shows the force-angle curve which is scanned at constant angular steps of Δϵ. The 180° point on the abscissa with the angle ϵ forms the lower dead point of the ram 18. At this point the force is at its maximum. With the formula $$s = r \cdot (l + \cos(\epsilon))$$

the crimping distance s is calculated from the angle ϵ. In the formula, "r" is the distance between the eccentric pin 21 and the center of the shaft 19.

Figure 10B:
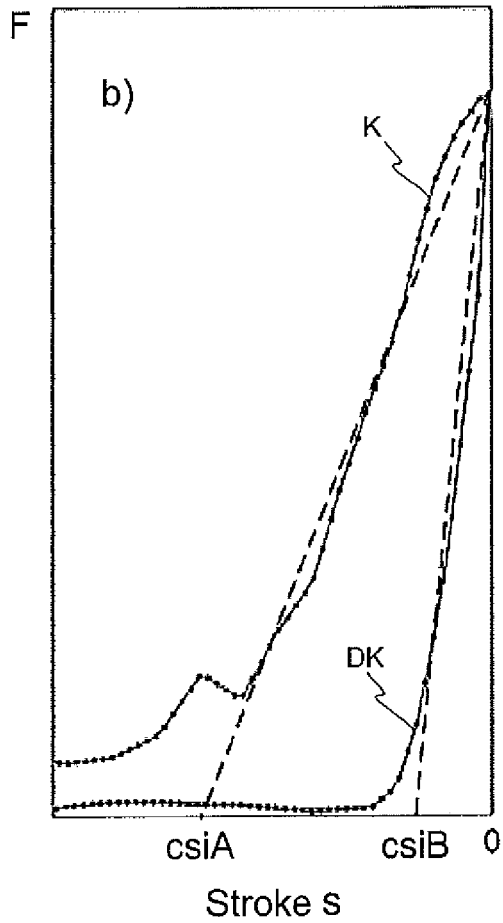
FIG. 10*b* shows a force-distance curve transformed from the force-angle curve according to FIG. 10*a;*

FIG. 10*b* shows the force-distance curve that is derived with this formula from the measured force-angle curve (FIG. 10*a*). The force-distance curve is divided into a compression phase K and a decompression phase DK. In the diagrams shown in FIGS. 10*b* to 15, the zero point is located to the right on the x axis.

Crimp Signature

Figure 11:
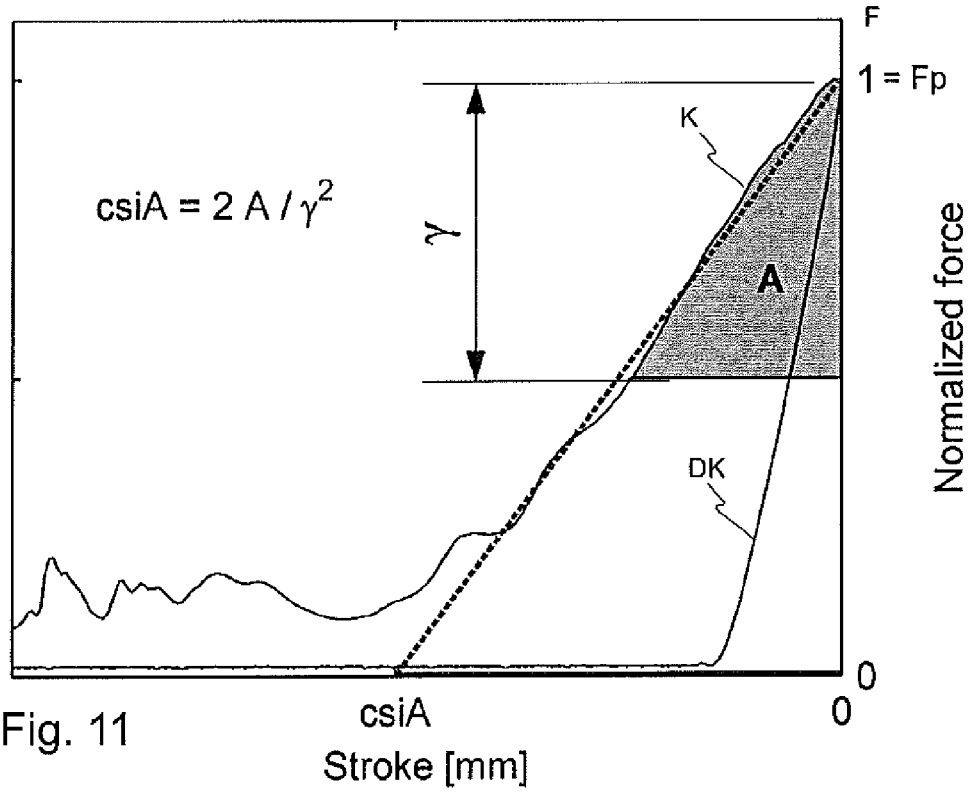
FIG. 11 is a diagram which shows the pattern of, the crimping force, normalized to 1, in relation to the distance with a parameter csiA which indicates the beginning of the compression phase.

FIG. 11 shows a diagram in which the pattern of the crimping force is displayed depending on the distance. This pattern is also referred to as a "crimp signature". Shown on the x axis is the crimping distance that the slide 22 of the ram 18 travels. The crimping distance is also referred to as the "stroke". Entered on the y axis is the force normalized to "1". The force axis is normalized because then the force sensor 23.1 (FIG. 7) need not be calibrated. It is thus sufficient if the force sensor 23.1 supplies a signal which is proportional to the exerted force F but not scaled absolutely. Normalization of the force axis allows the use of an inexpensive uncalibrated force sensor 23.1.

The crimping distance can be derived from the position signal 48 that is generated, by the linear sensor 20.

If the crimping press has no linear sensor 20, the crimping distance can be derived from the angle of rotation ϵ of the shaft (eccentric axis) 19. For this purpose, the angle of rotation ϵ is measured with the angle sensor 45 and transformed into a distance with the converter 50.

With the aid of the formula $$csiA = \frac{2A}{\gamma^2}$$

a parameter csiA can be determined which serves as measure for commencement of the compression phase K. The compression phase begins where the lugs 6 touch the conductor 12. Hereinafter, the parameter csiA is also referred to as Crimp Signature Index csiA.

In the formula, A is an area which in the compression phase lies under the crimping force curve, starts at a normalized force of 1−γ, and extends as far as the peak force Fp=1. Hereinafter, the area A is also referred to as "compression area". γ is a constant which is advantageously selected so that its value lies in the area of the constantly increasing force. In the present example γ=0.5.

Figure 12:
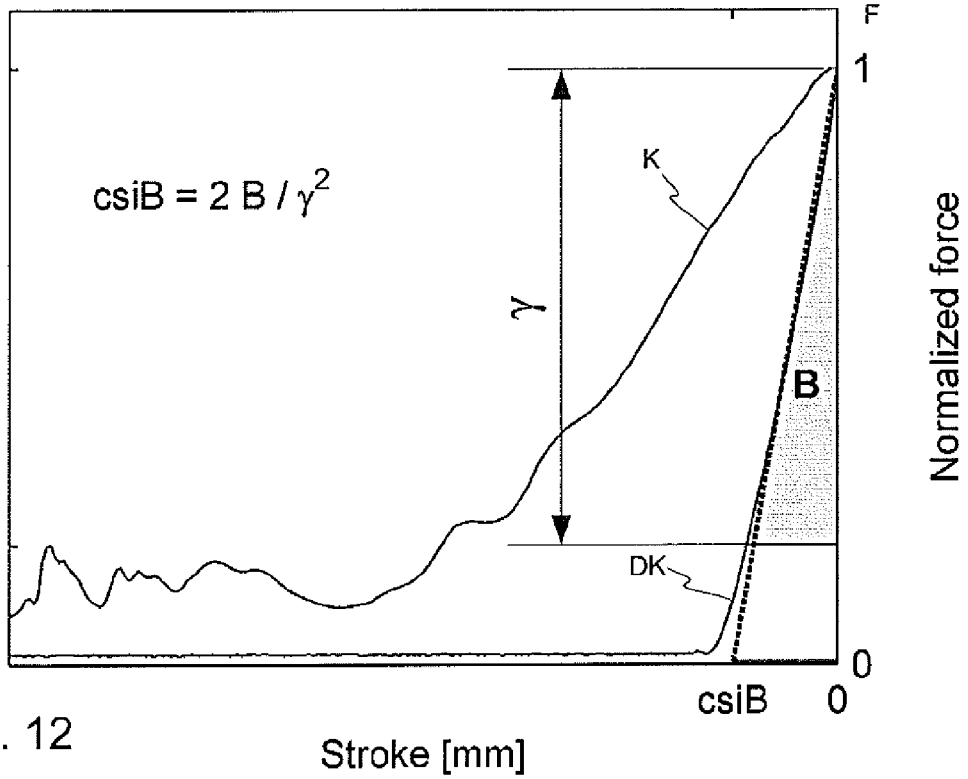
FIG. 12 shows the same pattern of the crimping force as in FIG. 11, but with a parameter csiB, which indicates the width of the decompression phase.

FIG. 12 shows the same pattern of the crimping force as in FIG. 11, but with a parameter csiB which characterizes the width of the decompression phase.

With the aid of the formula $$csiB = \frac{2B}{\gamma^2}$$

a parameter csiB as measure for the width of the decompression phase DK can be determined. The decompression phase DK begins after the eccentric pin 21 has reached the lower dead point and ends when the crimping stamp 8, 9 is removed from the contact 2. Hereinafter, the parameter or value csiB is also referred to as Crimp Signature Index csiB.

In the formula, B is the size of the area which in the decompression phase DK lies below the crimping force curve. Hereinafter, the area B is also referred to as "decompression area". Advantageously, the value of the constant γ lies in the area of the constant decline in force, and in the present example is 0.8.

If, for example, for the constant γ the value γ=0.8 is selected, the area B begins at a normalized force of 1−γ=0.2 and extends to the peak force Fp=1.

The formula applies $$Fp[N]=csiB[m]\cdot k[N/m]$$

where "k" is a constant

Since the Crimp Signature Index csiB is proportional to the peak force Fp, the formula applies $$csiB \sim Fp$$

From the values csiA and csiB a further Crimp Signature Index csiC is calculated:

$$csiC = \frac{csiA - csiB}{2}$$

Figure 13:
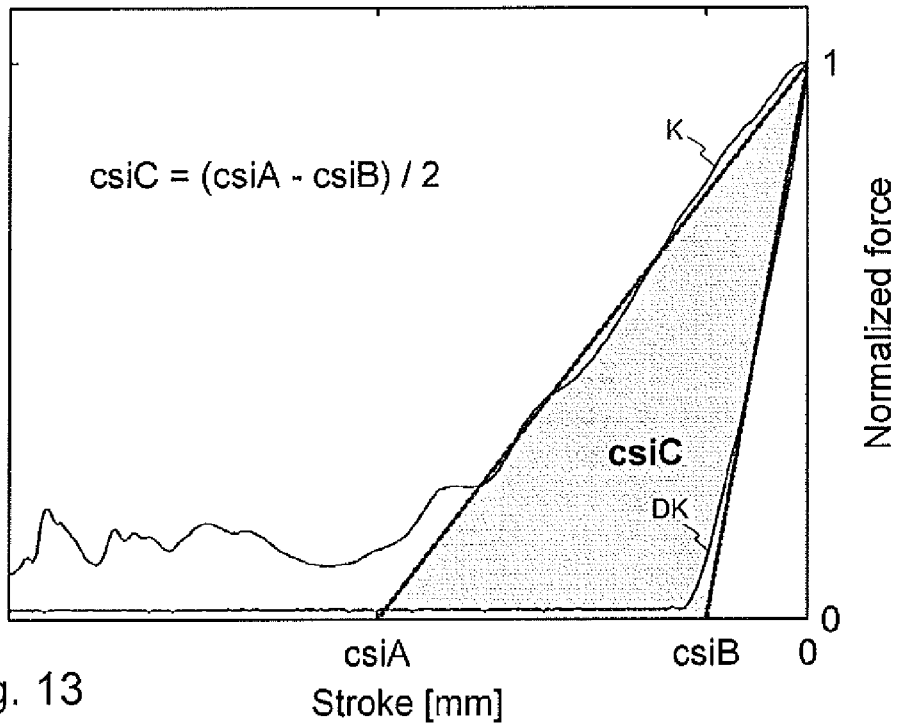
FIG. 13 shows the same pattern of the crimping force as in FIG. 11, but with a parameter csiC, which indicates the area of the compression.

As shown in FIG. 13, the Crimp Signature Index csiC corresponds to the area of the triangle with the base line csiA csiB and the height "1". This area is identical to the compression surface of the crimp signature.

The Crimp Signature Index csiC can be used to monitor the crimp height CH. A small change ΔCH in the crimp height CH causes an identically large change ΔcsiC of the Crimp Signature Index csiC with reversed sign. Hence the formula applies:

$$\Delta csiC=-\Delta CH$$

From the values csiC and csiB a further Crimp Signature Index csiD is calculated:

$$csiD = \frac{csiC}{csiB}$$

The Crimp Signature Index csiD can be used to detect a fault when setting up the crimping device. In particular, with the Crimp Signature Index csiD it can be detected whether the conductor was sufficiently stripped of insulation.

From the values csiB and csiC a further Crimp Signature Index csiE is calculated:

$$csiE=csiB\cdot csiC$$

The Crimp Signature Index csiE is proportional to the compression work of the crimping operation, and is hence also proportional to the Crimp Compression Ratio CCR:

$$csiE \sim CCR$$

The Crimp Signature Index csiE can also be used to detect a fault when setting up the crimping device. In particular, the Crimp Signature Index csiE can be used to verify whether the set crimp height CH, and the set wire cross section, match the specifications.

Determination of the Analysis Zones

Figure 14:
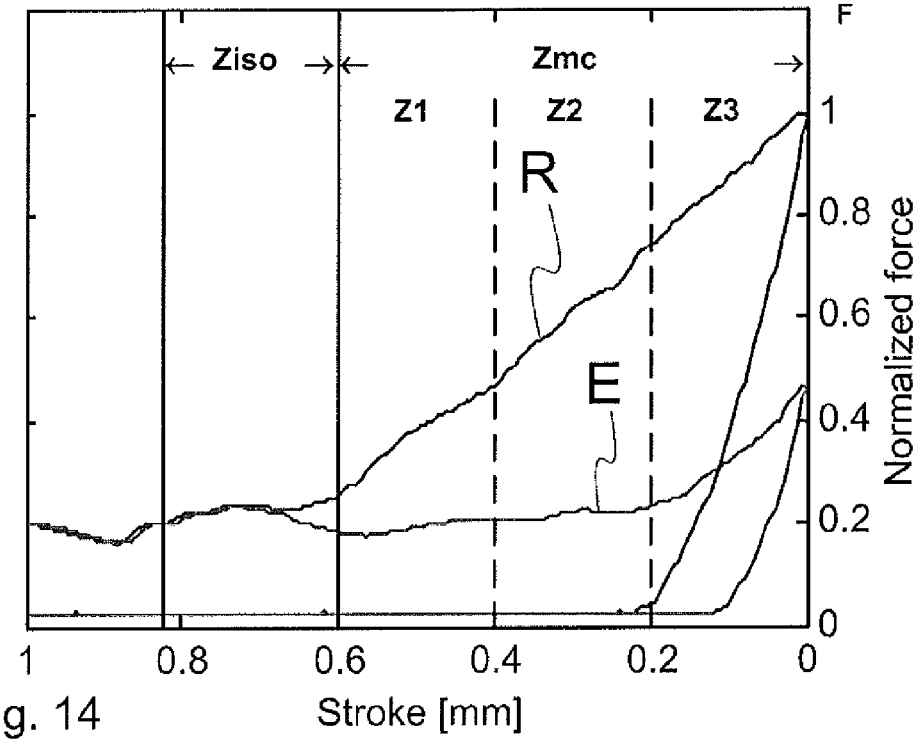
FIG. 14 shows a pattern of the crimping force which is subdivided into two analysis zones, Ziso and Zmc.

Described hereinafter by reference to FIG. 14 is how from the crimping force curve the analysis zones Ziso and Zmc are determined. The analysis zone Zmc is further subdivided into "N" subzones Z1, Z2, . . . , Zi, . . . , ZN, for N>2. In the following explanations, "N" is set to "3". FIG. 14 shows a first crimping force curve R for a reference crimp which is hereinafter referred to as Reference Crimping Force Curve R. In addition, FIG. 14 shows a second crimping force curve E, whose pattern is typical for a void crimp. Both crimping force curves R and E have the same analysis zones Ziso and Zmc. The analysis zone Zmc is additionally subdivided into three subzones Z1, Z2, and Z3.

The analysis zone Ziso is used to detect the crimp fault "Insulation in Crimp". The analysis zone Zmc is used to detect the crimp fault "Missing Strands".

To detect the crimp fault "Missing Strands", it is advantageous for the analysis zone Zmc to cover that section of the crimping force curve in which the compression of the strands takes place. However, the analysis zone Zmc should not be situated before this compression area, because otherwise unnecessary noise components will be analyzed. For this reason, the zone widths are defined by reference to the Crimp Signature Index csiA which, as stated above, indicates the start of the compression phase.

The analysis zone Zmc is calculated as follows:

$$Zmc=0.8\cdot W\cdot csiA=Z1+Z2+Z3$$

where "W" is a parameter which lies in the range from W=0.5 to 2.0 and for which the standard value is W=1.

The subzones Z1, Z2, and Z3 are determined as follows:

$$Z1=Z2=Z3=Zmc/3$$

The analysis zone Ziso is determined as follows:

$$Ziso=Zmc/3$$

Monitoring of the Crimp Height During Active Production

The crimp height is monitored with the Crimp Signature Index csiC. For this purpose, the Crimp Signature Index csiC during a crimping operation is determined and compared with a tolerance value chTol.

For the case that the crimp height, and thus the Crimp Signature Index csiC, of the crimp that is currently to be examined deviates too far from the reference crimp height, or in other words exceeds the tolerance value chTol, the production is switched off, which means that no further crimpings are executed.

Crimp Fault "Missing Strands"

Figure 15:
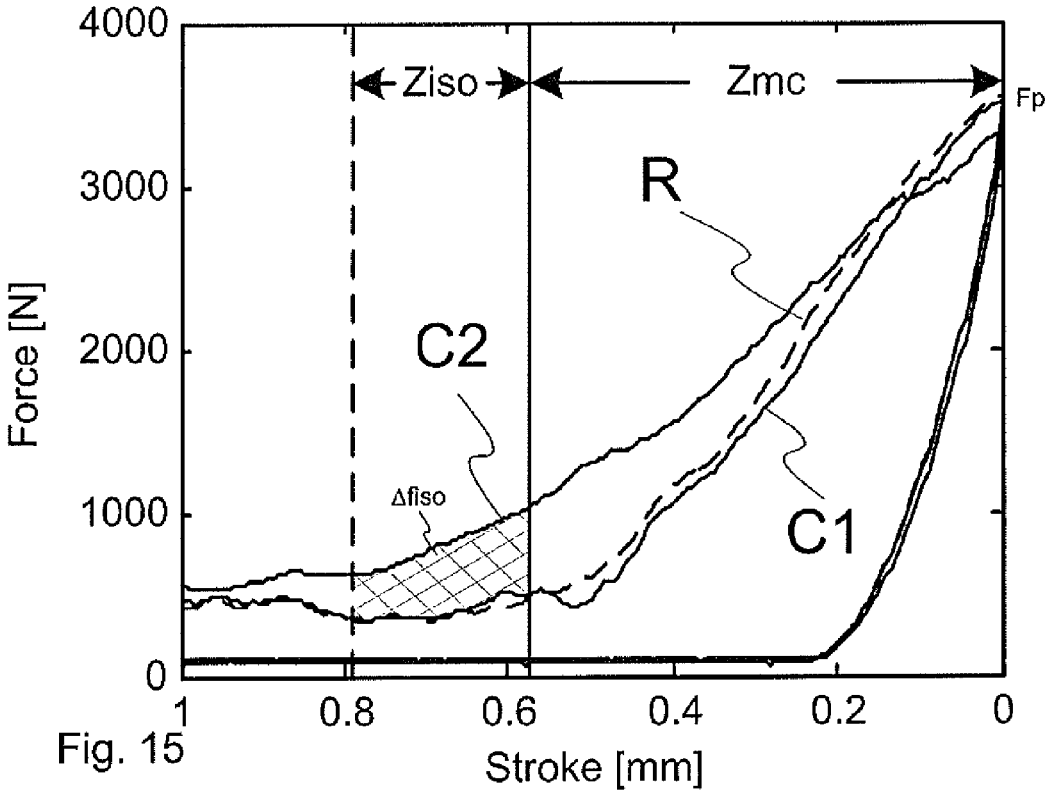
FIG. 15 shows the force-distance pattern for a faultless reference crimp R, a faulty crimp C1 with 10% missing strands, and a faulty crimp C2 with crimped-in insulation.

With the solution according to the invention, it can be detected whether, and also how many, strands of a conductor 12 (FIG. 4) were not crimped during the crimping. FIG. 15 shows a typical force-distance pattern R for a faultless crimp and a typical force-distance pattern C1 for a faultless crimp with 10% missing strands.

For the detection of faults, first a value Rmc, which gives the relative proportion of missing strands, and which is hereinafter also referred to as "result", is calculated as follows:

$$Rmc = ScaleFactorRmc \cdot \sum_{i=1}^{N} Si \cdot Ri$$

where ScaleFactorRmc is a scaling factor, Si is the weighting factor for the subzone Zi, and Ri is the relative area difference for the subzone Zi.

The value Rmc is then compared with a fault limit value BLMC. The fault limit value BLMC is also referred to as "fault limit".

The relative area difference Ri of a subzone Zi is calculated according to the following formula:

$$Ri = \frac{\sum_{Zi} f - \sum_{Zi} fRef}{\sum_{Zi} fRef}, \; i = 1 \ldots N$$

where f is the area that lies under the crimping force curve in the subzone Zi, and fRef is the reference area, which lies under the reference crimping force curve in the subzone Zi.

The relative area difference Ri is thus the difference between the area f, which lies under the crimping force curve in the subzone Zi, and the reference area fRef, which lies under the reference crimping force curve in the subzone Zi, divided by this reference area rRef.

The scatter of the value Rmc is reduced, and hence the discrimination for the detection of crimp faults is improved, if the weighting factors Si are determined corresponding to the relevance of the respective relative area difference Ri. The weighting factors Si are calculated according to the following formula:

$$Si = \left(\frac{Ri(ec)}{std(Ri)}\right)^2, \; i = 1 \ldots N$$

where Ri(ec) is the relative area difference of the subzone Zi for a void crimp "ec" and std(Ri) is the standard deviation of Ri, determined over a relatively large number of faultless crimps.

The scaling factor ScaleFactorRmc serves to scale the value Rmc, so that Rmc corresponds to the relative proportion of missing strands.

To determine the scaling factor ScaleFacorRmc, a faulty crimp with a defined proportion mc % of missing strands is executed. If, for example, 2 of 19 strands are missing, the value mc is given by mc=2/19*100=10.5%. If, for example, a void crimp is executed, in other words a contact is crimped without conductor, the value mc is given by mc=1/1*100=100%. The scaling factor ScaleFacorRmc is now determined in such manner that the result of this faulty crimp Rmc=−mc %.

For the case that the result Rmc for the crimp that is currently to be examined exceeds the fault limit—BLMC, the production is, for example, switched off, i.e. no further crimpings are executed. However, instead of this, the crimp can be designated as "reject" without the production being stopped.

To determine the fault limit BLMC, several crimps are executed. Then, from the good crimps, the standard deviation std(Rmc) of the Rmc results is calculated. Further, the required proportion of missing strands in percent is specified with the value MCL. If, as value of MCL, for example, MCL=10% is specified, this means that the system should detect 10% missing strands with certainty. The calculation of the fault limit BLMC is now as follows:

$$BLMC = MCL - a \cdot std(Rmc)$$

where the factor "a" has, for example, the value "3".

Figure 16A:
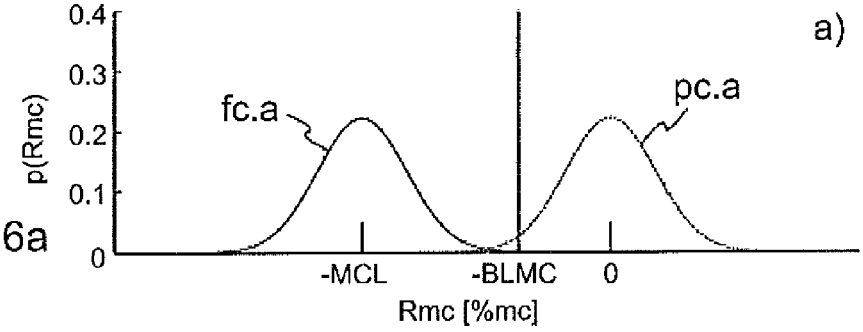
FIG. 16*a* shows a distribution density function for the case that the weighting factors S1, S2, and S3 are equally large.
Figure 16B:
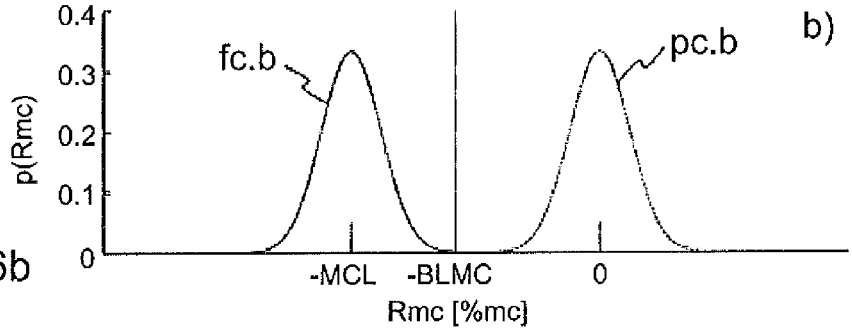
FIG. 16*b* shows a distribution density function for the case that the weighting factors S1, S2, and S3 were optimally selected so that the scatter of the Rmc values is minimal.

FIGS. 16*a* and 16*b* explain these interrelationships. With the value MCL, the percentage proportion of missing strands is specified that should be detected with certainty. Shown in FIG. 16*a* is a first distribution density function of the value of Rmc. FIG. 16*b* shows a second distribution density function of Rmc. In the distribution density functions shown in FIGS. 16*a* and 16*b*, the variable Rmc is entered on the x axis. Shown on the y axis is the relative frequency p(Rmc) with which the variable Rmc displays a specified value. The distribution density function of Rmc has its maximum at the mean value of Rmc. The width of the distribution density function is defined by the scatter of Rmc, expressed as the standard deviation std(Rmc). In FIGS. 16*a* and 16*b*, the distribution density functions of the Rmc values of the faultless crimps are designated with pc.a and pc.b respectively. The distribution density functions of the Rmc values with MCL mc % missing strands are designated in FIGS. 16*a* and 16*b* with fc.a and fc.b respectively.

For the distribution density functions fc.a and pc.a according to FIG. 16*a*, the weighting factors Si are of equal magnitude. It can be seen that the discrimination—expressed as the fault limit BLMC—for the fault detection based on the wide scatter of the Rmc values is insufficient. Although the Rmc values of the faulty crimps (see distribution density function fc.a) are all smaller than the fault limit—BLMC, so that the faulty crimps are detected, some of the Rmc values of the faulty crimps (see distribution density function pc.a) are also smaller than the fault limit—BLMC and are thus erroneously classified as faulty.

FIG. 16*b* shows the case in which the weighting factors, as described above, were determined according to the relevance of the relative area differences Ri. The scatter of the Rmc values is smaller, and the two probability densities pc.b and fc.b do not overlap each other. Sufficient discrimination is hence given. The faulty crimps are classified as "bad", and the faultless crimps as "good".

Crimp Fault "Insulation in the Crimp"

A further possible fault when crimping can be that between the contact 2 (FIG. 4) and the conductor 12 there is still a greater or lesser amount of insulation material 11. In FIG. 15, in addition to the typical force-distance pattern for a faultless crimp R, a typical force-distance pattern for a faulty crimp with crimped-in insulation C2 is also shown.

To identify a crimp with crimped-in insulation as being faulty, the relative area difference Riso from the zone Ziso is compared with a limit value BLISO. The limit value BLISO is also designated as "fault limit".

The relative area difference Riso is calculated as follows:

$$Riso = \frac{fiso - fRefiso}{fRefiso} = \frac{\Delta fiso}{fRefiso}$$

The relative area difference Riso is thus the difference between the area fiso, which lies under the crimping force curve C2 in the analysis zone Ziso, and under the reference area fRefiso, which lies under the reference crimping force curve R in the zone Ziso, divided by this reference area rRefiso.

For the case that the relative area difference Riso for the crimp that is currently to be tested exceeds the area limit value BLISO, the crimp is, for example, designated as "reject".

To determine the fault limit BLiSO, several crimpings are executed. From the good crimpings, the fault limit BLISO is then statistically calculated.

Determination of the Process Parameter

Before a crimped connection can be processed for the first time, the process parameters must first be determined. These, are then saved in a database and can be called up each time for the production of the corresponding crimped connection. The process parameters include:

The Crimp Signature Indices csiA0, csiB0, csiC0, csiD0, and csiE0;

The fault limits BLMC and BLISO;

The weighting factors S1, S2, and S3;

The scaling factor ScaleFactorRmc.

Set-up of the Crimping Process

When setting up the crimping process on the automatic crimping machine, it must be ensured that the crimped connection matches the specifications. It must in particular be verified whether the specified wire cross section is processed, and whether the crimped connection has the specified crimp height CH.

Setting-up, with the subsequent automatic verification, can, for example, proceed as follows. In a first step, the specified crimp height CH is set as follows. After a first crimp is produced, the operating person measures the crimp height CH and adjusts the crimping tool. This is repeated until the crimp height CH lies within the tolerance. In a second step, the setup is verified automatically. For this purpose, the current Crimp Signature Index csiE is compared with the process parameter csiE0 that is stored in the database. If the difference between csiE and csiE0 lies within the tolerance, i.e. the crimp height CH and the conductor cross section are in order, the production is released.

The foregoing description of the exemplary embodiments according to the present invention serves only illustrative purposes and not the purpose of restricting the invention. Within the scope of the invention, various changes, combinations of the embodiments, and modifications are possible without exceeding the scope of the invention or its equivalents.

LIST OF REFERENCE NUMBERS

1 Wire
2 Contact
3 Crimp zone
4 Double lug
5 Insulation crimp
6 Double lug
7 Conductor crimp
8 Crimping stamp
9 Crimping stamp
9.1 Anvil
10 Notch
11 Conductor insulation
12 Conductor
13 Window
14 Stand
15 Motor
16 Gearbox
17 Guide
18 Ram
19 Shaft
20 Linear measurement system
21 Eccentric pin
22 Slide
23 Tool holder
23.1 Force sensor
28 Control
40 Motor controller
41 Control unit
42 External computer
43 Capacitor
44 Discharging switch
45 Angle sensor
46 Voltage amplifier
47 Analog-digital converter
48 Impulse sequence of the distance increments
49 Impulse sequence of the angle increments
50 Angle-to-distance transformation unit
A Area
B Area
BLMC Fault limit value
C Capacity
CCS Cross-sectional area of the conductor crimp
CH Crimp height
csiA Crimp Signature Index
csiB Crimp Signature Index
csiC Crimp Signature Index
csiD Crimp Signature Index
csiE Crimp Signature Index
CW Crimp width
C1 Crimping curve
C2 Crimping curve
DK Decompression phase
E Crimping curve
F Crimping force
fc.a distribution density function
fc.b distribution density function
Fp Peak force
Δfiso area difference
g Amplification factor
K Compression phase
MCL Missing strands value
pc.a distribution density function
pc.b distribution density function
p(Rmc) relative frequency
q Charge
R Reference crimp curve
Rmc Fault detection value
s Stroke distance
TCS Cross-sectional area of the contact u Output voltage
WCS Cross-sectional area of the conductor
Ziso Analysis zone
Zmc Analysis zone
Z1 Subzone
Z2 Subzone
Z3 Subzone
$\epsilon$ Angle
$\Delta\epsilon$ Angular step
$\gamma$ Constant In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for determining the quality of a crimped connection between a conductor and a contact comprising the steps of:

a. operating a crimping device to exert a crimping force on the conductor and the contact;

b. determining a crimping force curve that occurs during the crimping representing the crimping force exerted versus a stroke distance of the crimping device;

c. determining a compression surface that lies under a reference crimping force curve, wherein the compression surface corresponds with a triangular area (csiC) defined by a pair of parameter points (csiA, csiB) of a base line disposed under the reference crimping force curve and along an axis representing the stroke distance, and a point of peak force (Fp) disposed on an axis representing the crimping force exerted;

d. subdividing into several adjacent zones the crimping force curve and the reference crimping force curve along the compression surface, the subdivision taking place under consideration of the size of the compression surface; and e. determining at least one further area that lies under the crimping force curve in a zone outside and adjacent to the zones of the compression surface, the at least one further area being a measure for the quality of the crimping connection.

2. The method according to claim 1 wherein the compression surface is determined under a section of the reference crimping force curve in which the crimping force increases.

3. The method according to claim 2 wherein a maximum crimping force defines an upper end of the section.

4. The method according to claim 1 wherein one of the pair of parameter points (csiA) is a first Crimp Signature Index (csiA) and is determined from the size of the compression surface.

5. The method according to claim 4 wherein the zones are individually weighted.

6. The method according to claim 4 wherein from the reference crimping force curve for each of the zones a reference area is determined, from a respective crimping force curve for each of the zones an area is determined, therefrom area differences and therefrom in turn a total area difference are determined, and based on the total area difference, determining whether one or more strands of the conductor are missing.

7. The method according to claim 4 including determining, from a reference crimping force curve, a size of the reference area in which in one of the zones lies under the reference crimping force curve, determining from the crimping force curve, an area which lies in the zone under the crimping force curve, determining from the reference area and the area, the area difference, and determining, based on the area difference, whether insulation material is present in the crimp between the conductor and the contact.

8. The method according to claim 1 including determining a decompression area that lies under the reference crimping force curve, wherein the decompression area is determined under a section of the reference crimping force curve in which the crimping force declines.

9. The method according to claim 1 including determining one of the pair of parameter points (csiB) as a Crimp Signature Index (csiB) under consideration of the decompression area.

10. The method according to claim 9 including determining another of the pair of parameter points (csiA) as a Crimp Signature Index (csiA) under consideration of the compression surface and wherein the another Crimp Signature Index (csiA) and the Crimp Signature Index (csiB) are used to infer a crimp height.

* * * * *